US006552664B2

(12) United States Patent
Nishikawa et al.

(10) Patent No.: US 6,552,664 B2
(45) Date of Patent: Apr. 22, 2003

(54) METHOD OF FABRICATING A FIRE DETECTOR

(75) Inventors: Takayuki Nishikawa, Osaka (JP); Shinji Kirihata, Kyoto (JP); Takeshi Wada, Tsu (JP); Yasuyuki Kawano, Hirakata (JP); Shoichi Oka, Matsuzaka (JP); Koji Sakamoto, Takarazuka (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/926,197

(22) PCT Filed: Jan. 26, 2001

(86) PCT No.: PCT/JP01/00508

§ 371 (c)(1),
(2), (4) Date: Sep. 24, 2001

(87) PCT Pub. No.: WO01/55991

PCT Pub. Date: Aug. 2, 2001

(65) Prior Publication Data

US 2002/0158767 A1 Oct. 31, 2002

(30) Foreign Application Priority Data

Jan. 26, 2000 (JP) ..... 2000-016977

(51) Int. Cl.[7] ..... G08B 21/00

(52) U.S. Cl. ..... 340/630; 340/581; 340/517; 340/521

(58) Field of Search ..... 340/630, 581, 340/517, 521, 632

(56) References Cited

U.S. PATENT DOCUMENTS

| | | | | |
|---|---|---|---|---|
| 6,014,076 | A * | 1/2000 | Luzzader | 340/521 |
| 6,075,447 | A | 6/2000 | Nightingale et al. | |
| 6,114,967 | A | 9/2000 | Yousif | |
| 6,344,802 | B1 * | 2/2002 | Otsuka et al. | 340/825.69 |
| 6,189,389 | B1 * | 3/2002 | Buccola | 340/517 |
| 6,320,501 | B1 * | 11/2002 | Tice et al. | 340/517 |

FOREIGN PATENT DOCUMENTS

| | | |
|---|---|---|
| EP | 0 571 843 | 12/1993 |
| EP | 0 729 123 | 8/1996 |

OTHER PUBLICATIONS

Patent Abstracts of Japan, JP 3–250395, Nov. 8, 1991.

* cited by examiner

*Primary Examiner*—Julie Lieu
(74) *Attorney, Agent, or Firm*—Oblon, Spivak, McClelland, Maier & Neustadt, P.C.

(57) ABSTRACT

A method of fabricating various models of fire detectors only from a limited number of common parts or unit in accordance with user's specific needs but at a reduced cost. The method utilizes a smoke sensor unit (1), a thermal sensor unit (2), a signal processing unit (3), a signal transmission unit (4), and a power unit (5), and then combines at least one of the smoke sensor unit and the thermal sensor unit with the power unit and optionally with at least one of the signal processing unit and the signal transmission unit.

10 Claims, 10 Drawing Sheets arithmetic processor
I/O processor
A/D converter
oscillator
oscillator
transmission interface
address memory
temperature sensor
oscillator
adjustor
voltage amp
voltage amp
I/V converter
LED driver
comparator
controller
power supply
signal transfer circuit
switch circuit
non-polarization circuit
receiver
T11
T12
T13
T14
T15
T21
T22
T31
T32
T33
T34
T35
T36
T37
T41
T42
T43
T44
T45
T46
T47
T51
T52
T53
T54
T55
T56
1
2
3
4
5
6
10
11
12
13
14
15
16
17
18
19
20
30
31
32
33
40
41
42
50
51
52
53
60 arithmetic processor
I/O processor
A/D converter
oscillator
temperature sensor
oscillator
adjustor
voltage amp
voltage amp
I/V converter
LED driver
controller
comparator
power supply
signal transfer circuit
switch circuit
non-polarization circuit
receiver
T21
T22
T31
T32
T33
T34
T35
T36
T37
T11
T12
T13
T14
T15
T51
T52
T53
T54
T55
T56
1
2
3
5
6
10
11
12
13
14
15
16
17
18
19
20
30
31
32
33
50
51
52
53
60

METHOD OF FABRICATING A FIRE DETECTOR

TECHNICAL FIELD

The present invention is related to a method of fabricating a fire detector, and more particularly to a method of fabricating various types of fire detectors by selecting a combination of common units, and to fire detectors thus fabricated.

BACKGROUND ART

There have been proposed a wide variety of fire detectors designed for specific purposes or situations. In terms of a fire sensing elements, the fire detectors can be classified generally into three types of using a smoke sensor, a thermal sensor, and a combination thereof. Also, the fire detectors can have different schemes of determining an outbreak of fire or fire-presence, for example, by analyzing a sensed parameter of the smoke density and/or temperature in accordance with a sophisticated program, or simply by comparing the parameter with a reference value. Further, the fire-presence signal may be simply a short-circuit signal on a transmission line to a receiver, or may carry address assigned to each detector for precisely locating the presence of fire at the receiver. Therefore, depending on specific particular needs in consideration of a scale of fire detection system, an environment, cost and other factors, the detector is selected from a large number of combinations of the sensing elements, the fire-presence determination schemes, and the transmission of the fire-presence signal. The detectors of different specifications have been fabricated individually as different models in conformity with various needs. However, the different models are normally designed to have exclusive parts some of which are not shared with other models. This becomes critical when most of the parts of the detector are integrated into a single chip. Therefore, a manufacture has to prepare and stock a large kinds of exclusive parts for production of various types of the detector, which leads to a cost increase of the fire detector.

DISCLOSURE OF THE INVENTION

In view of the above problem, the present invention has been accomplished to provide a method which enables to fabricate various models of fire detectors only from a limited number of common parts or units. Therefore, it is a primary object of the present invention to provide a method which is capable of producing various models of fire detectors in accordance with user's specific needs at a reduced cost. The method in accordance with the present invention utilizes a smoke sensor unit 1, a thermal sensor unit 2, a signal processing unit 3, a signal transmission unit 4, and a power unit 5, and then combines at least one of the smoke sensor unit and the thermal sensor unit with the power unit and optionally with at least one of the signal processing unit and the signal transmission unit.

The smoke sensor unit is provided to sense a smoke density and generate a smoke density signal indicative thereof, in addition to generating a fire-determination signal indicative of the fire-presence or not as determined based upon the sensed smoke density. The smoke sensor unit includes a power input terminal T11 for receiving an operating voltage, a smoke density output terminal T13 for providing the smoke density signal, and a fire-determination output terminal T14 for providing the fire-determination signal.

The thermal sensor unit 2 is provided to sense an environmental temperature and generate a temperature signal indicative thereof. The thermal sensor unit includes a power input terminal T21 for receiving the operating voltage, and a temperature output terminal T22 for providing the temperature signal.

The signal processing unit 3 is provided to determine the fire-presence based upon any of the smoke density signal and said temperature signal, and to generate a fire-determination signal. The signal processing unit has a smoke density input terminal T33 for receiving the smoke density signal, a temperature input terminal T32 for receiving the temperature signal, a fire-determination output terminal T34 for providing the fire-determination signal, an interrogation signal input terminal T35 for receiving an interrogation signal, and a power input terminal T31 for receiving the operating voltage.

The signal transmission unit 4 is responsible for signal transmission with a receiver 6 and is configured to convert the fire-determination signal into a multiplex signal for multiplex transmission to the receiver, and to transform the interrogation signal from the receiver into a suitable format to be processed at the signal processing unit 3. The signal transmission unit has a power input terminal T41 for receiving the operating voltage, an interrogation input terminal T45 for receiving the interrogation signal, a fire-determination input terminal T42 for the fire-determination signal, an interrogation signal output terminal T43 for transmitting the interrogation signal, and an multiplex signal output terminal T46 for transmitting the multiplex signal to the receiver through the power unit.

The power unit 5 is provided to give the operating voltage and includes a switch circuit 18 which is connected to the receiver for providing a short-circuit signal when the fire-determination signal indicates the fire-presence. Also included in the power unit is a transfer circuit 52 which transfers the interrogation signal from the receiver to the signal transmission unit as well as the multiplex signal from the signal transmission unit to the receiver. The power unit has a power output terminal T51 for providing the operating voltage, a multiplex signal input terminal T56 for receiving the multiplex signal, an interrogation output terminal T55 for providing the interrogation signal, a fire-determination input terminal T54 for receiving the fire-determination signal, and a port T52, T53 for connection with the receiver.

Since each unit is configured to have the input and output terminals for immediate connection with those of a corresponding unit or units, the detector in any desired combination of the units can be readily assembled.

In a preferred embodiment, at least one of the smoke sensor unit, the thermal sensor unit, the signal processing unit, the signal transmission unit, the power unit is prepared In the form of an integrated circuit for facilitating the assembly of the detector, in addition to making the detector compact.

One example of the fire detector fabricated in accordance with the present invention is equipped with all the units 1 to 5, in which the smoke sensor unit 1 has the smoke density output terminal T13 connected to the smoke density input terminal T33 of the signal processing unit 3, the thermal sensor unit 2 has the temperature output terminal T22 connected to the temperature input terminal T32 of the signal processing unit 3, the signal processing unit 3 has the fire-determination output terminal T34 connected to the fire-determination input terminal T42 of the signal transmission unit 4, the signal processing unit 3 has the interrogation input terminal T35 connected to the interrogation output terminal T43 of the signal transmission unit 4, the signal transmission unit 4 has the multiplex signal output terminal T46 connected to the multiplex signal input terminal T56 of the power unit 5, the signal transmission unit 4 having the interrogation input terminal T45 connected to the interrogation output terminal T55 of the power unit 5, and the power unit 5 has the power output terminal T51 connected to the power input terminals T11, T21, T31, and T41 of the smoke sensor unit, the thermal sensor unit, the signal processing unit, the signal transmission unit.

These and still other objects and advantageous features of the present invention will become more apparent from the following description of the embodiment when taken in conjunction with the attached drawings.

MODE FOR CARRYING OUT THE INVENTION

Figure 1:
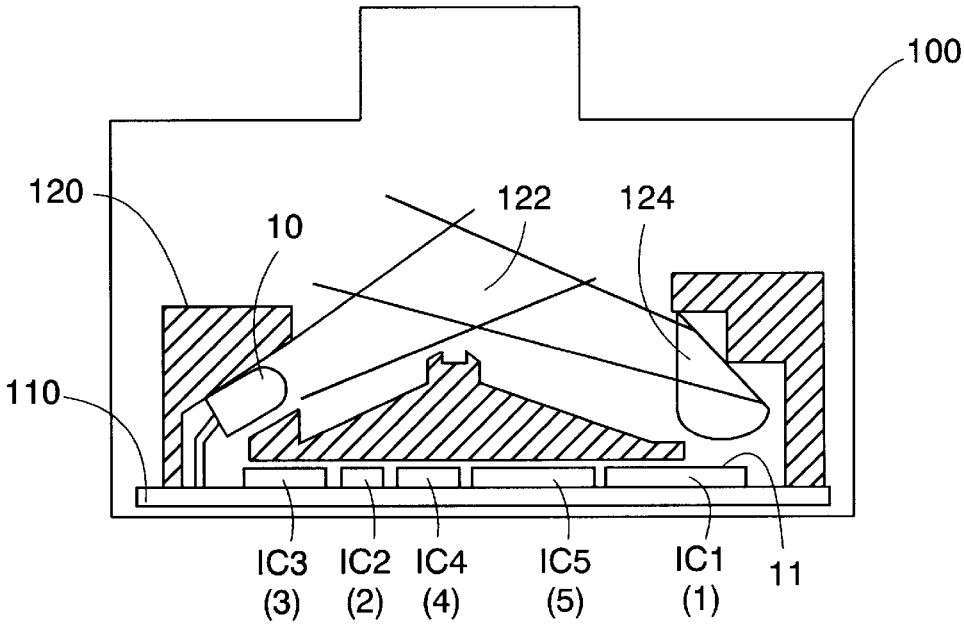
FIG. 1 is a schematic sectional view illustrating a fire detector fabricated in accordance with a preferred embodiment of the present invention.
Figure 2:
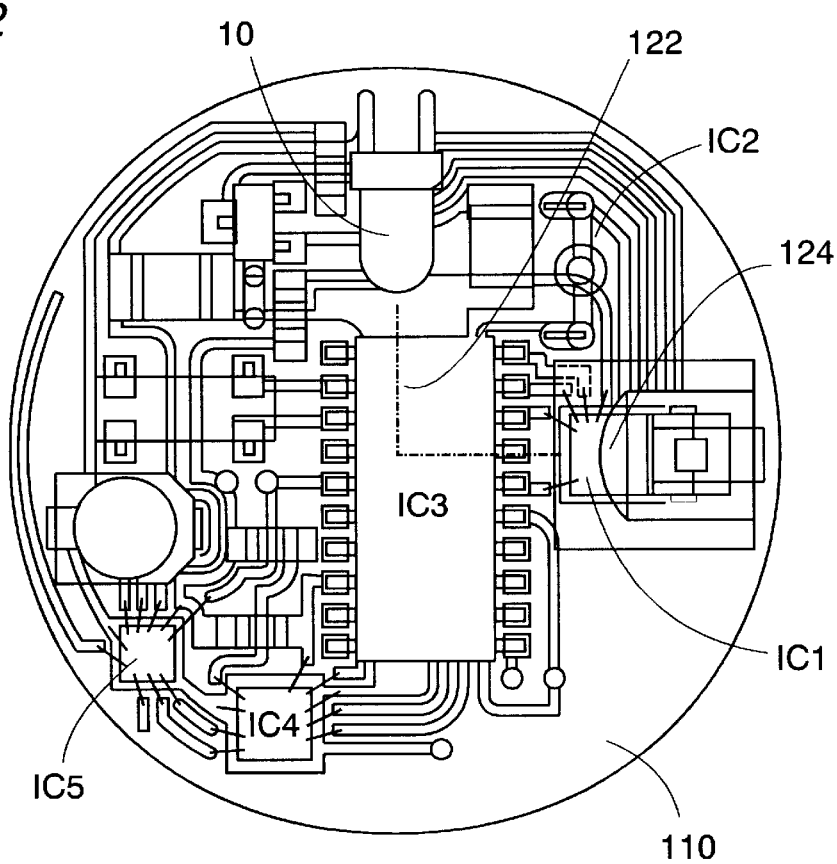
FIG. 2 is a plan view of various integrated units of the above detector mounted on a printed board.

Referring now to FIGS. 1 and 2, there is shown a typical fire detector fabricated in accordance with a preferred embodiment of the present invention. The fire detector comprises a housing 100 accommodating therein a printed board 110 which mounts thereon integrated circuit chips IC1, IC2, IC3, IC4, and IC5 respectively forming a smoke sensor unit 1, a thermal sensor unit 2, a signal processing unit 3, a signal transmission unit 4, and a power unit 5. These units are prepared as common units for assembling various types of fire detectors, as will be discussed hereinafter. An optical guide 120 is also mounted on the printed board 110 to form an open bent path 122 for capturing an outside air with possible smoke particles. A light emitting diode (LED) 10 is disposed at one end of the path 122, while a light receiving element such as a photo-diode 11 is disposed at the other end of the path 122 to receive a diffused light from the LED 10 through a prism 124 to flow a current of varying level indicative of a smoke density of the air. The current is then analyzed to determine an outbreak or presence of fire around the detector. The LED 10 and the photo-diode 11 may be incorporated in the chip IC1 of the smoke sensor unit or may be mounted on or around the chip. Also, the path 122 may extend horizontally at an angle different from the illustrated one, and the LED 10 and photo-diode 11 may be arranged in a spatial relation differently than the illustrated example. A few elements or parts may be mounted on the printed board around the corresponding chip rather than being integrated in the chip. Such elements may include the LED 10, photo-diode 11, an oscillator such as a quartz oscillator, and an address memory such as EEPROM. Although few elements may be external to the corresponding chips, the input and output terminals for connection with the other unit or chip are concentrated on the chip so that the unit including the external element may be regarded as forming a single module in relation to the other unit. The printed board 110 is designed simply for interconnection of the units by wire bonding and can be therefore commonly utilized to various combinations of the units. Although each unit is preferred to be integrated into the chip or package, it may be realized on a discrete board or the like. Further, the input and output terminal of each unit may be arranged to form one or more sockets for interconnection with the corresponding unit by use of a complementary plug or cable.

Figure 3:
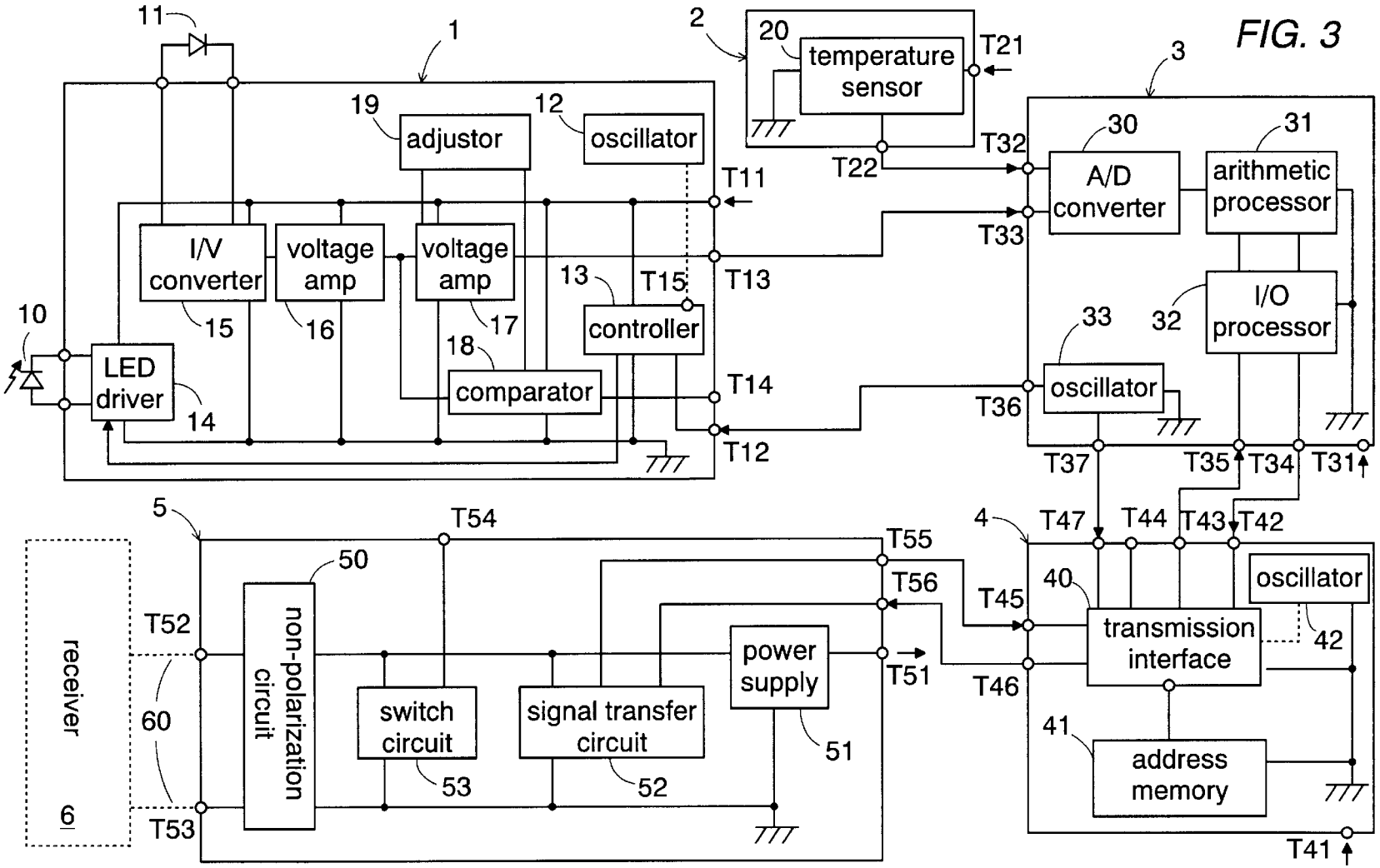
FIG. 3 is a circuit block diagram illustrating one example of the fire detector.

FIG. 3 shows one type of the fire detector equipped with all the units, namely, the smoke sensor unit 1, the thermal sensor unit 2, the signal processing unit 3, the signal transmission unit 4, and the power unit 5. The detector is wired together with the same or other types of detectors on a two-wire bus leading to a station receiver 6 which supervises the detectors regularly in order to check the fire-presence detected at the detector and gives a warning message for prompting a suitable cease-fire action. The units are deigned as multi-purpose units capable of being commonly utilized for various combinations of the units, or various types of the fire detector, as will be discussed hereinafter.

<Smoke Sensor Unit 1>

The smoke sensor unit 1 includes, in addition to the LED 10 and the photo-diode 11, an oscillator 12, a controller 13, an LED driver 14, current-voltage converter 15, a two-stage voltage amplifier 16 and 17, a comparator 18 and an adjustor 19. Further, the unit 1 has a power input terminal T11 for receiving a DC voltage from the power unit 5, an oscillation signal input terminal T12, a smoke density signal output terminal T13, and a fire-determination signal output terminal T14. The controller 13 receives an oscillation signal, i.e., clock signal either from the internal oscillator 12 or from an external oscillator 33 provided in the signal processing unit 3 through terminal T12 to generate a LED timing signal by which the LED driver 14 activates LED 10 intermittently as well as a timing signal for intermittently energizing converter 15 and amplifier 16 and 17 in synchronous with the activation of LED 10. In this example, the controller 13 utilizes the clock signal supplied from the signal processing unit 3 rather than from the internal oscillator 12 which is provided to give the oscillation signal to an internal terminal T15 of controller 13 in case the external oscillator is not available. In this connection, the controller 13 has a function of selecting the internal oscillator 12 and the external oscillator manually or automatically. Although the intermittent activation or energization of the elements is preferred for saving energy consumption, the smoke sensor unit may be so designed to be constantly energized.

The current generated at the photo-diode 12 in proportion to the received light intensity is converted at the converter 15 into a voltage which is then amplified through amplifier 16 and 17 to provide a smoke density signal indicative of the sensed smoke density. The smoke density signal is fed through the terminal T13 to the signal processing unit 3 for determination the fire-presence. The comparator 18 is provided to determine the fire-presence by comparing the voltage indicative of the smoke density with an internal threshold and to provide a fire-determination signal indicative of the fire-presence or not. In the illustrated instance where the fire-presence is determined at the signal processing unit 3, the comparator 18 is not required to determine the fire-presence. However, when the signal processing unit 3 or external fire-presence determination function is not available as will be discussed in the following examples with reference to FIGS. 7 and 8, the comparator 18 is utilized to determine the fire-presence. For this purpose, the comparator 18 may have an additional function of being selectively activated depending upon the combinations of the units.

The adjustor 19 is provided to adjust a gain of the amplifier 17 as well as the threshold at the comparator 18. The adjustor is therefore realized by a variable resistor which may be mechanical or electronically adjusting type, or even a resistor of which resistance is adjusted by a known laser trimming technique.

The LED 10 and the photo-diode 11 may be integrated to the chip IC1 so that the entire unit 1 can be handled and mounted on the printed board as a single module.

<Thermal Sensor Unit 2>

The thermal sensor unit 2 includes a temperature sensor 20 such as a thermistor for sensing an environmental temperature and generating a temperature signal indicative of the temperature. The thermal sensor unit 2 is connected to the power unit 5 and the signal processing unit 3 as illustrated. Thus, the thermistor 20 is energized by the DC voltage supplied from the power unit 5 through a power input terminal T21 and provides the temperature signal through a temperature output terminal T22 to the signal processing unit 3.

<Signal Processing Unit 3>

The signal processing unit 3 is prepared in the form of a molded package IC3 which includes an A/D converter 30, a logic circuit of an arithmetic processor 31, an I/O processor 32, and an oscillator 33. The unit 3 is energized by the DC voltage received at a power input terminal T31 connected to the power output terminal T51 of the power unit 5. The AD converter 30 is connected to a smoke density input terminal T33 and a temperature input terminal T32 for receiving the smoke density signal from the smoke sensor unit 1 as well as the temperature signal from the thermal sensor unit 2, and converts these signals into digital data which are analyzed in the arithmetic processor 31 to determine the fire-presence in accordance with a dedicated program. For example, the digital data are analyzed in comparison with predetermined thresholds and also in consideration of an aging effect on the optical system so as to assure a reliable fire-presence determination while compensating for errors, such as a stray light effect due to a strain on the optical system. Upon determination of the fire-presence or not, the processor 31 generates a fire-determination signal which is fed through the I/O processor 32 to a fire-determination output terminal T34. The signal processing unit 3 is also provided with an interrogation signal input terminal T35 for receiving an interrogation signal from the receiver 6 through the power unit 5 and the signal transmission unit 4. In response to the interrogation signal, the processor 31 performs a routine of determining the fire-presence and sending back the fire-determination signal indicative of the fire-presence or not. The processing unit 3 includes the oscillator 33 which provides the oscillation signal or clock signal for operation of the signal processing unit 3. The clock signal is also supplied to the smoke sensor unit 1 and to the signal transmission unit 4 respectively through oscillation signal output terminals T36 and T37. Further, the arithmetic processor 31 may be designed to execute a sophisticated program, in answer to the interrogation signal, for analyzing the digital data of the smoke density and the temperature with respect to the time sequence to predict the outbreak of fire as well as to execute an error check routine for increased reliability of the fire-determination.

<Signal Transmission Unit 4>

The signal transmission unit 4 includes a transmission interface 40, an address memory 41, and an oscillator 42. The unit 4 is energized by the DC voltage received at a power input terminal T41 connected to the power output terminal T51 of the power unit 5. The transmission interface 40 is connected to an oscillation signal input terminal T47 for receiving the clock signal from the external oscillator 33 of the signal processing unit 3, and to a fire-determination input terminal T42 for receiving the fire-determination signal from the unit 3. The interface 40, which is a logic circuit, utilizes the clock signal to generate a multiplex signal carrying the fire-determination signal in conformity with an algorithm of the receiver 6. The multiplex signal also carries an address of the fire detector fetched from the address memory 41, for example, made of EEPROM or dip switch. The multiplex signal is transmitted through a multiplex signal output terminal T46 to the receiver 6 where the multiplex signal is processed to see that the fire is detected at which fire detector. The address memory 41 may be alternatively provided in the signal processing unit 3.

The interface 40 is also connected to an interrogation signal input terminal T45 to receive the interrogation signal from the receiver 6 and transform it into a suitable format to be processed at the processor 31 in the signal processing unit 3. Thus transformed interrogation signal is fed to an interrogation signal output terminal T43 connected to the corresponding input terminal T35 of the signal processing unit 3. The oscillator 42 is reserved for providing the clock signal to the interface 40 in case the external oscillator 33 is not available as seen in another example shown in FIG. 7. Therefore, the interface 40 is given a function of selecting the internal oscillator 42 or the external oscillator either manually or automatically. Further, the signal transmission unit 4 is provided with an extra fire-determination input terminal T44 which is reserved for connection with the corresponding output terminal T14 of the smoke sensor unit 1 when the smoke sensor unit 1 is directly connected to the signal transmission unit 4 as in the example of in FIG. 7.

<Power Unit 5>

The power unit 5 has a pair of ports T52 and T53 for connection with the receiver 6 through the two-wire bus 60, and includes a non-polarization circuit 50 which allows non-polarized connection of the power unit 5 to the bus 60. The circuit 50 is realized by a diode bridge and feeds a line voltage received from the bus to an internal power supply 51 which in turn provides the DC voltage to the power output terminal T51 for energizing the other units 1 to 4. Also included in the unit 5 is a signal transfer circuit 52 which is responsible for transmitting the fire-determination signal from the signal transmission unit 4 to the receiver 6 as well as the interrogation signal from the receiver 6 to the unit 4 respectively through a fire-determination input terminal T56 and an interrogation signal output terminal 55. The unit 5 additionally includes a switch circuit 53 which is capable of providing a short-circuit signal or low level voltage signal when the fire-determination signal received at a fire-determination input terminal T54 indicates the fire-presence. In this example, the terminal T54 is left open but is reserved for receiving the fire-determination signal not through the signal transmission unit 4, as will be explained in other examples with reference to FIGS. 4, 8, and 10.

The non-polarized circuit 50 may be external to the corresponding chip IC5 but is mounted on the printed board 110 immediately around the chip IC5 as forming a single module of the power unit 5. In this connection, it is noted that all the input and output terminals of each unit are concentrated on the corresponding IC chip. Whereby, the combination of the units can be made simply by bonding together the necessary terminals without requiring any intervening circuit forming parts or elements except for the printed board.

Figure 4:
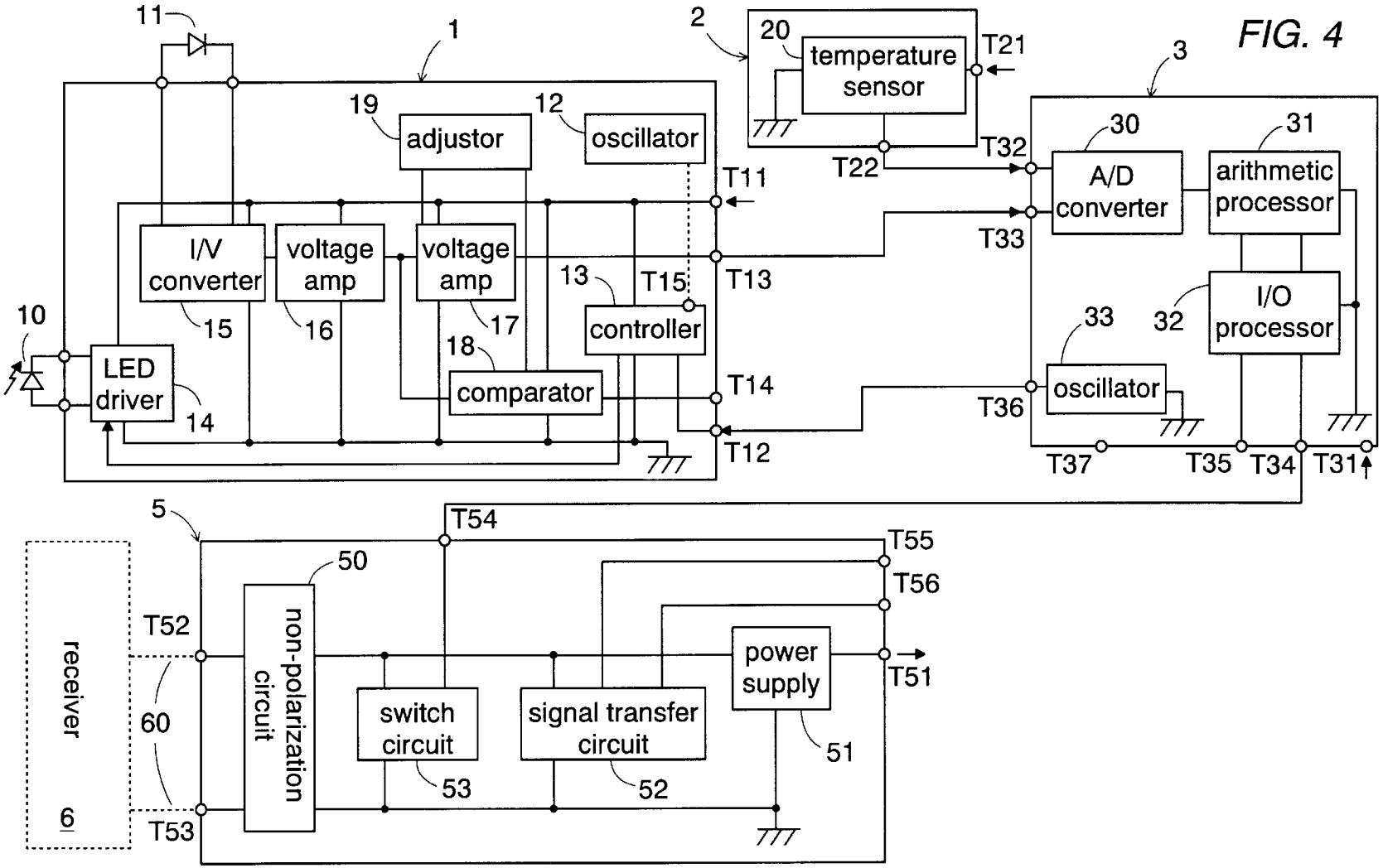
FIGS. 4 to 11 are circuit block diagrams illustrating other different examples of fire detectors respectively fabricated in accordance with the present invention.

FIG. 4 shows a second example of the fire detector fabricated in accordance with the present invention which utilizes the smoke sensor unit 1, the thermal sensor unit 2, the signal processing unit 3, and the power unit 5. In this example, the output terminal T34 of the signal processing unit 3 is connected to the input terminal T54 of the power unit 5 so as to transmit the fire-determination signal from the unit 3 directly to the unit 5 so that the switch circuit 53 can respond to generate the short-circuit signal, i.e., a low level voltage signal which is acknowledge by the receiver 6 as indicative of the fire-presence. The units are interconnected at the corresponding terminals as illustrated in FIG. 4.

Figure 5:
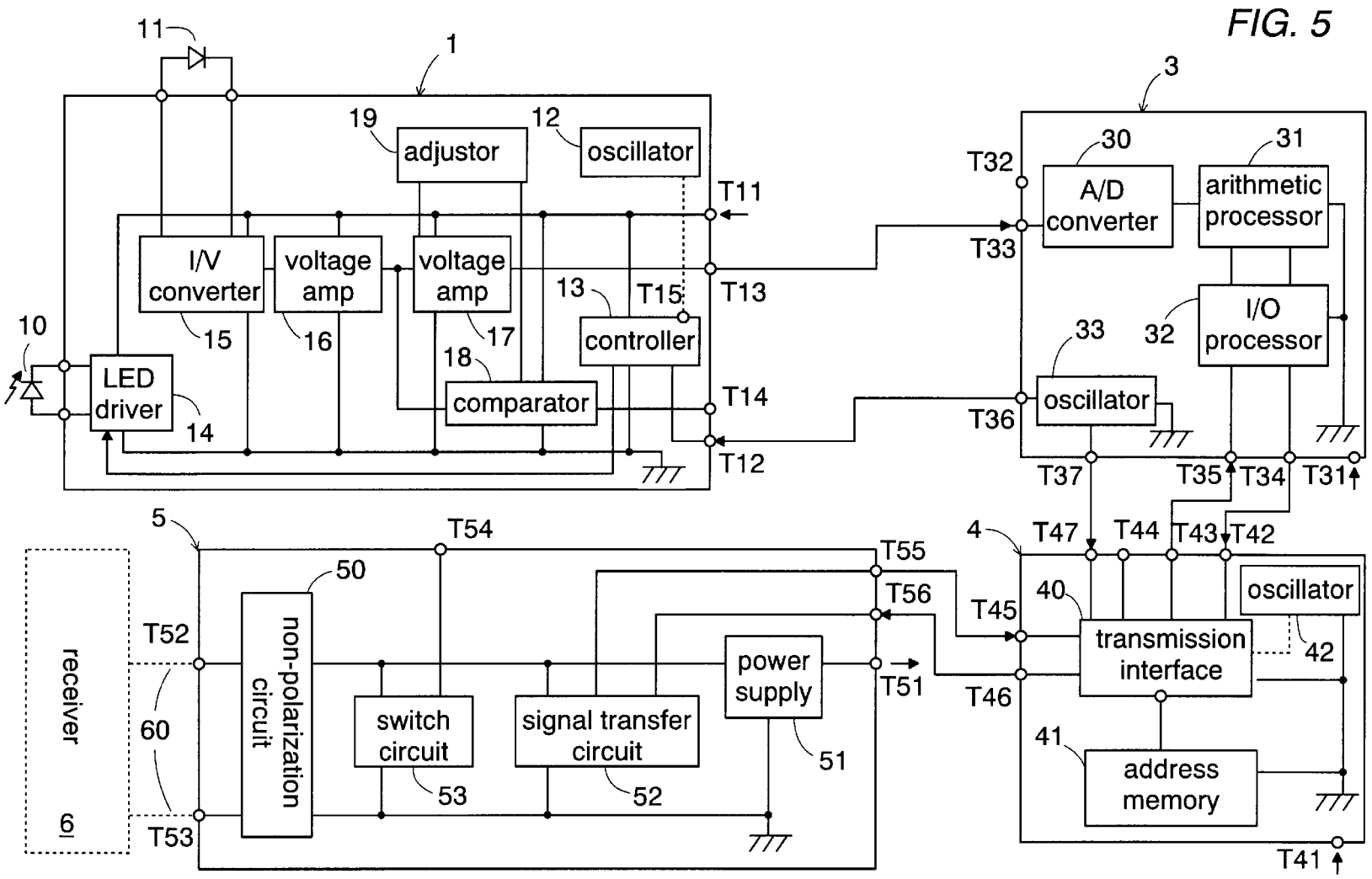

FIG. 5 shows a third example of the fire detector fabricated in accordance with the present invention which utilizes the smoke sensor unit 1, the signal processing unit 3, the signal transmission unit 4, and the power unit 5. This example is identical to the first example of FIG. 3 except that the thermal sensor unit 2 is omitted.

Figure 6:
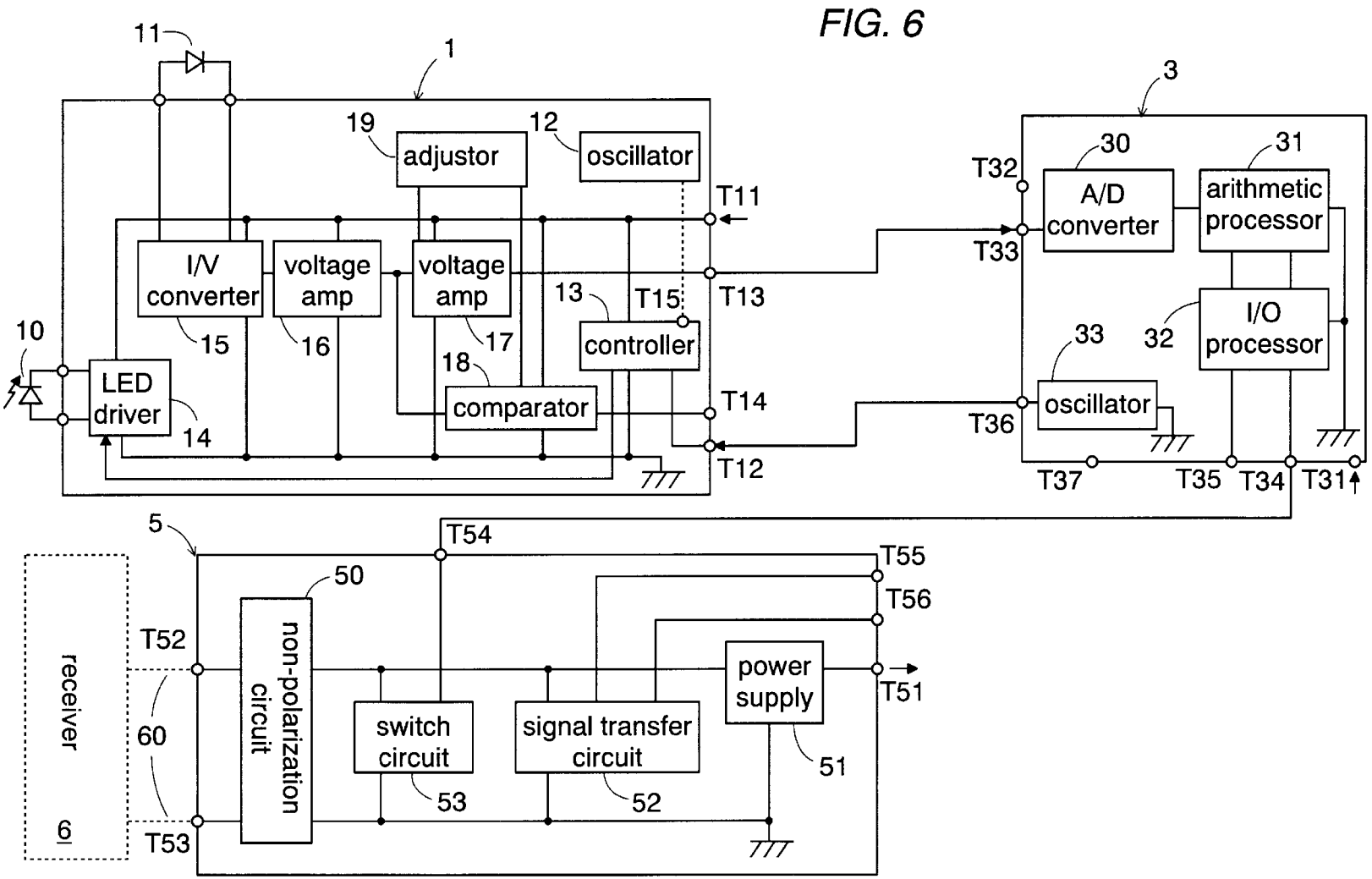

FIG. 6 shows a fourth example of the fire detector fabricated in accordance with the present invention which utilizes the smoke sensor unit 1, the signal processing unit 3, and the power unit 5. This example is identical to the second example of FIG. 4 except that the thermal sensor unit 2 is omitted.

Figure 7:
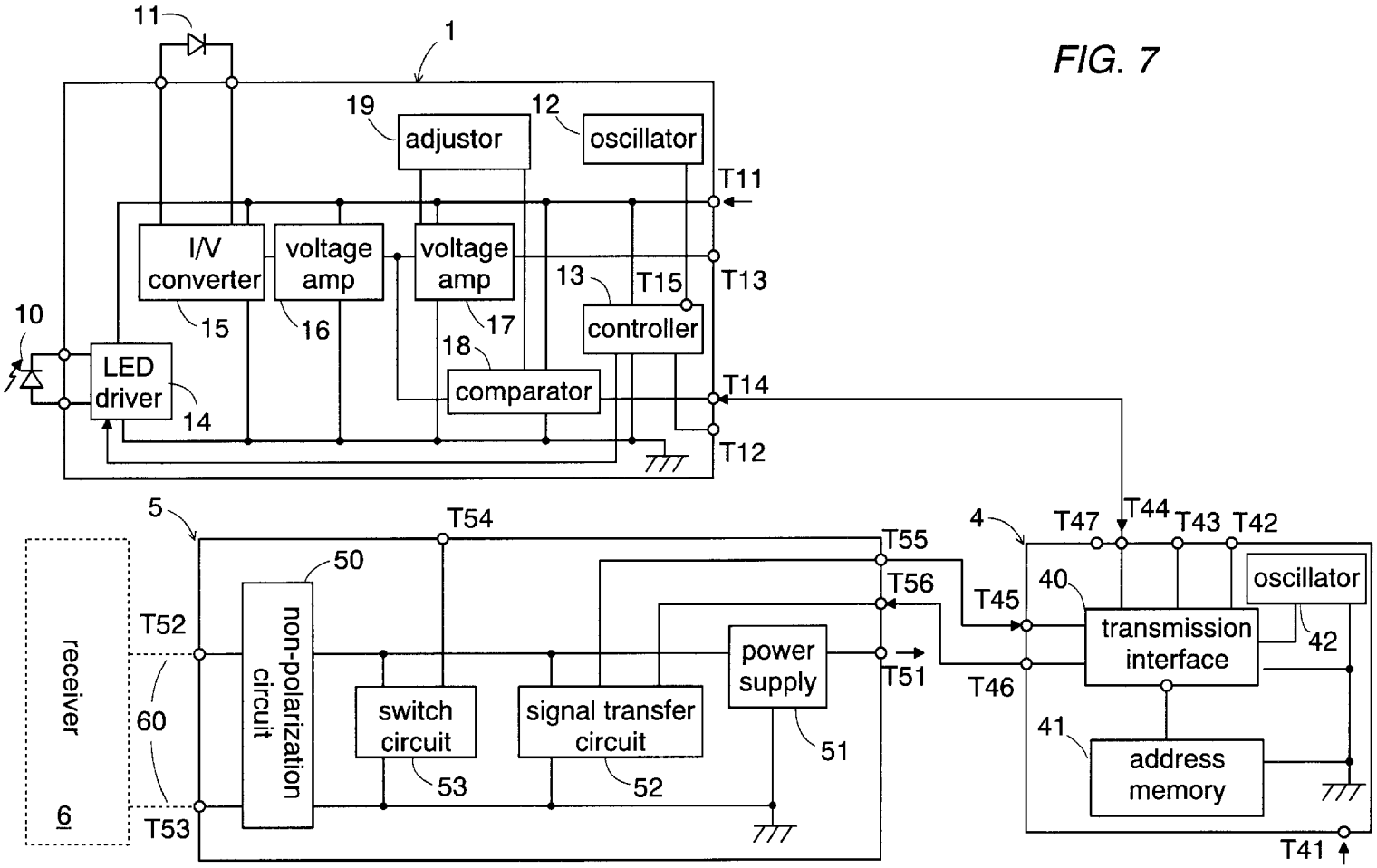

FIG. 7 shows a fifth example of the fire detector fabricated in accordance with the present invention which utilizes the smoke sensor unit 1, the signal transmission unit 4, and the power unit 5. This example is identical to the third example of FIG. 5 except that the signal processing unit 3 is further omitted. In this example, the fire-determination output T14 of the smoke sensor unit 1 is connected directly to the corresponding terminal T44 of the unit 4 so that the fire-determination signal generated within the smoke sensor unit 1 is transmitted together with its address to the receiver 6. The connection is bilateral so that the interrogation signal can be transmitted to the comparator 18 of the smoke sensor unit 1 from the receiver 6 through the power unit 5. In this respect, the comparator 18 is given the same capability as in the processor 31 of the signal processing unit 3 for determination of the fire-presence in answer to the interrogation signal from the receiver 6. Note that, due to the omission of the unit 3, the oscillators 12 and 42 of the respective units 1 and 4 are made active to provide the oscillation signals for operation of the units.

Figure 8:
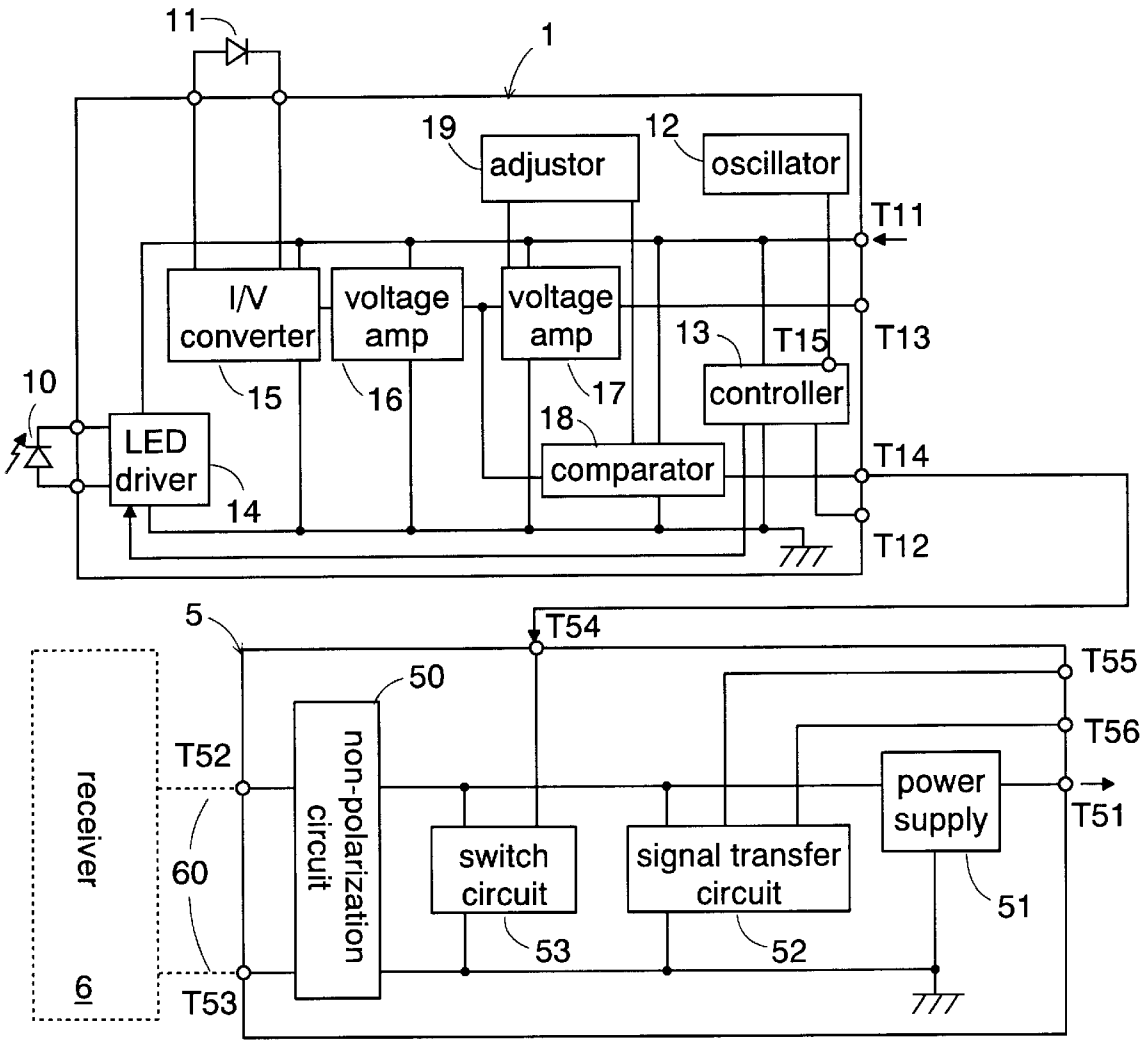

FIG. 8 shows a sixth example of the fire detector fabricated in accordance with the present invention which utilizes the smoke sensor unit 1 and the power unit 5. In this example, the fire-determination output terminal T14 is connected directly to the corresponding input terminal T54 of the power unit 5 so that the switch circuit 53 can generate the short-circuit signal in response to the fire-detection at the comparator 18 of the smoke sensor unit 1. Also, in this example, the controller 13 of the smoke sensor unit 3 is caused to utilize the internal oscillator 12. The comparator 18 is responsible for determination of the fire-presence based upon the sensed smoke density, but does not rely upon the extra function of answering the interrogation signal.

Figure 9:
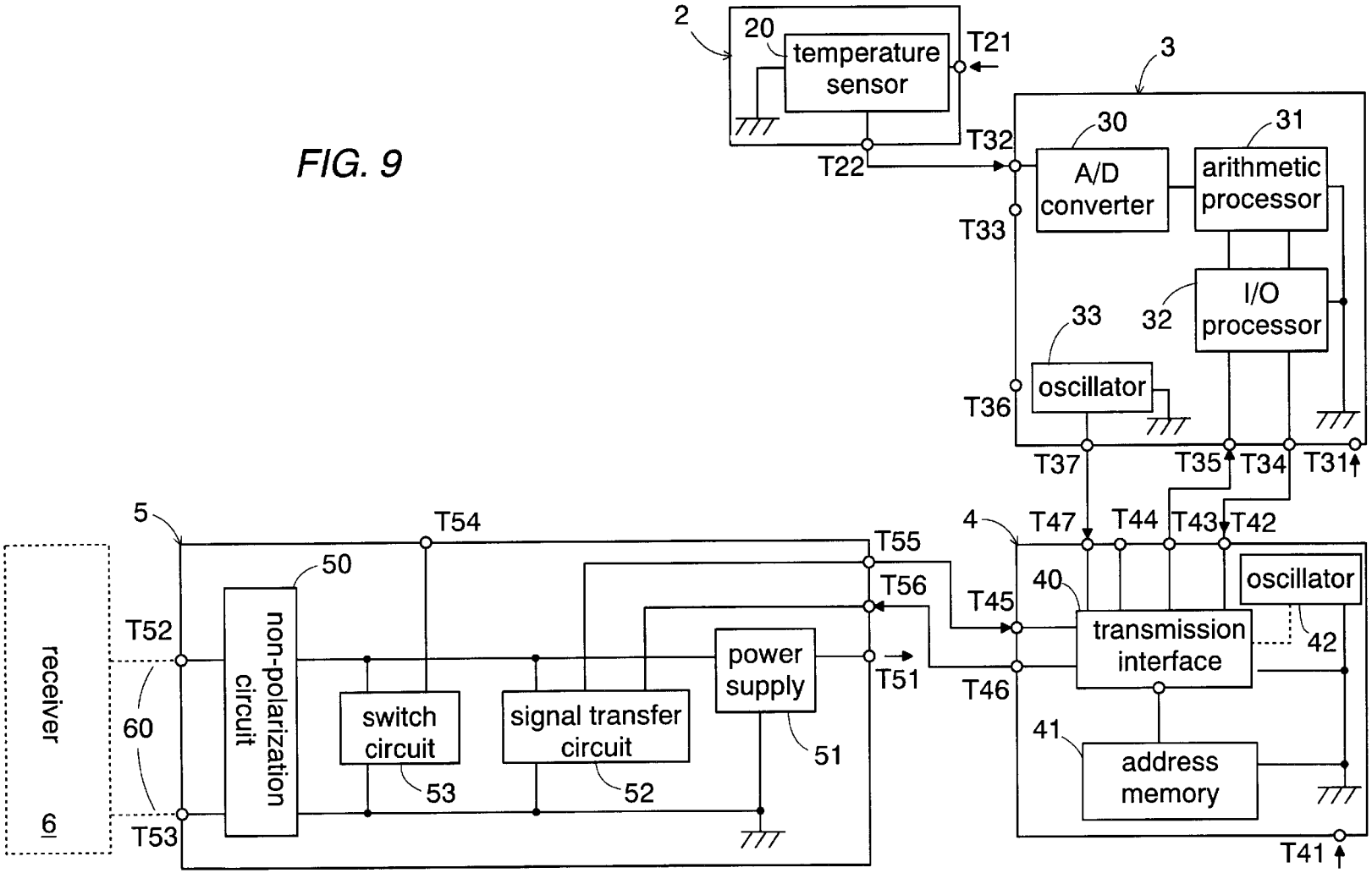

FIG. 9 shows a seventh example of the fire detector fabricated in accordance with the present invention which utilizes the thermal sensor unit 2, the signal processing unit 3, the signal transmission unit 4, and the power unit 5. This example is identical to the first example except for omission of the smoke sensor unit 1. Thus, the fire-determination is made based only upon the temperature.

Figure 10:
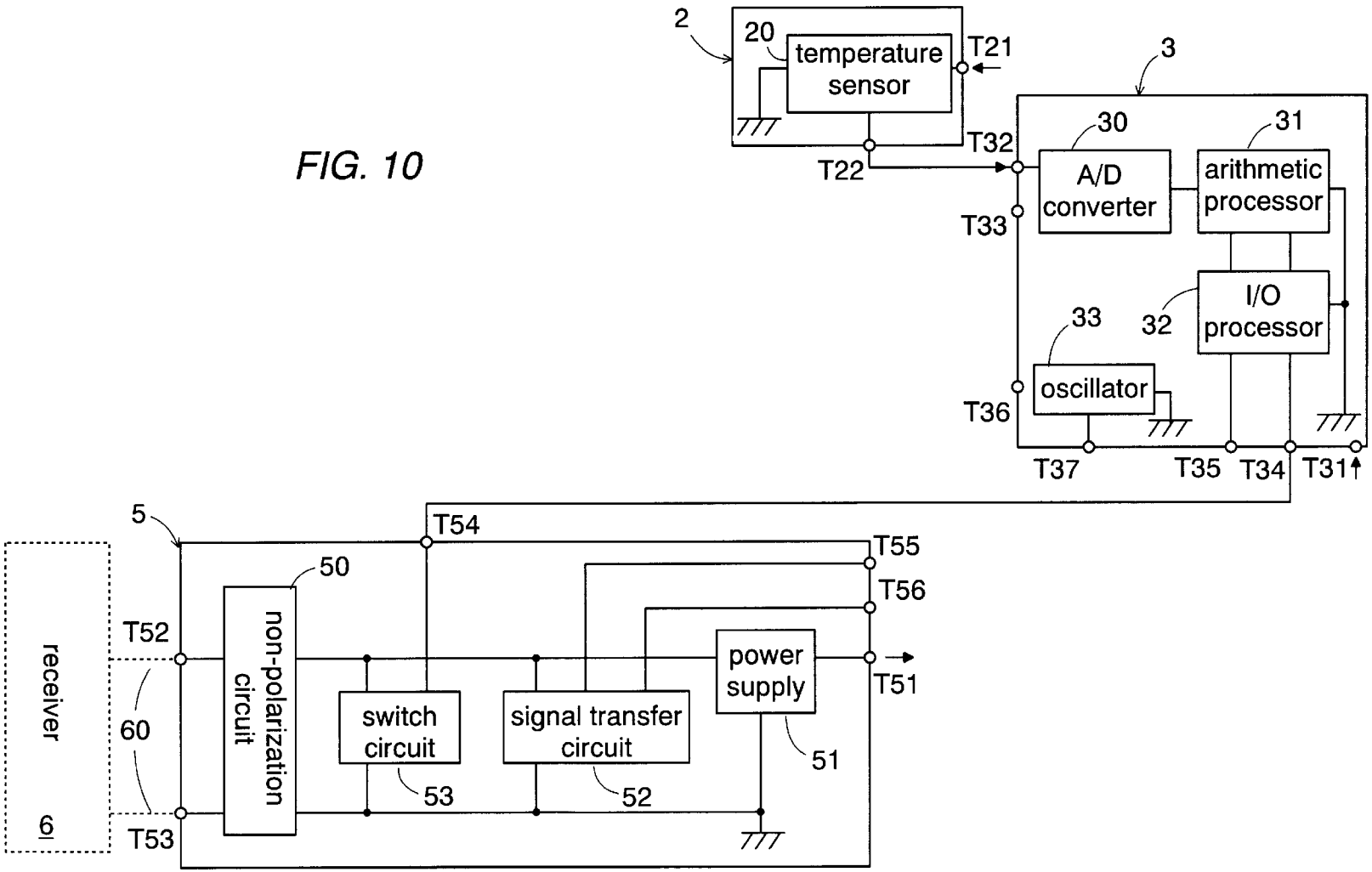

FIG. 10 shows an eighth example of the fire detector fabricated in accordance with the present invention which utilizes the thermal sensor unit 2, the signal processing unit 3, and the power unit 5. In this example, the fire-determination output terminal T34 is connected directly to the corresponding input terminal T14 of the power unit 5 to transmit the fire-determination signal to the switch circuit 18. Thus, when the fire-determination signal indicates the fire-presence, the switch circuit 18 generates the short-circuit signal by which the receiver 6 acknowledges the fire-presence.

Figure 11:
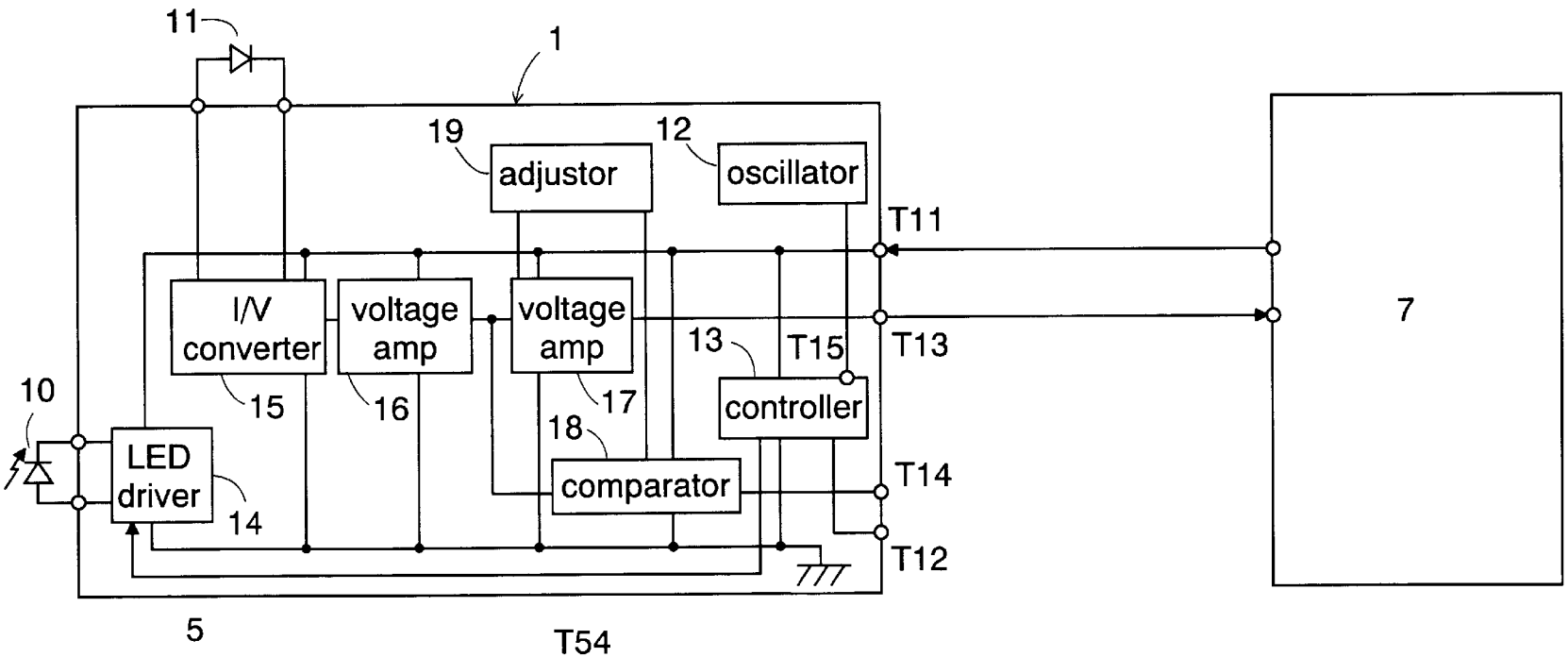

FIG. 11 shows another example in which the smoke sensing unit 1 can be singly applied to a system for removing the smoke particles. In this system, the smoke sensing unit 1 is connected to a receiver device 7 such as air cleaner having a smoke particle trapping filter or a ventilator exhausting the smoke particle born air. The receiver device 7 is designed to supply the DC voltage to the power input terminal T11 of the smoke sensor unit 1 and receive the smoke density signal therefrom. Also, the device 7 includes a processor which determines degree of pollution based upon the sensed smoke density and activates a suitable mechanism for removing the some particles.

In the foregoing description, the connections between the terminals should be recognized with reference to the corresponding drawings when not specified.

What is claimed is:

1. A method of fabricating a fire detector utilizing:

a smoke sensor unit which generates a smoke density signal indicative of a sensed smoke density as well as determines the fire-presence or not based upon the sensed smoke density to generate a fire-determination signal indicative of the determination, said smoke sensor unit having a power input terminal for receiving an operating voltage, a smoke density output terminal for providing said smoke density signal, and a fire-determination output terminal for providing said fire-determination signal;

a thermal sensor unit which senses an environmental temperature to generate a temperature signal indicative thereof, said thermal sensor unit having a power input terminal for receiving the operating voltage, and a temperature output terminal for providing said temperature signal;

a signal processing unit which determines the fire-presence or not based upon one of said smoke density signal and said temperature signal and generates a fire-determination signal indicative of the determination, said signal processing unit having:

a smoke density input terminal for receiving said smoke density signal, a temperature input terminal for receiving said temperature signal, a power input terminal for receiving the operating voltage, a fire-determination output terminal for providing the fire-determination signal, and an interrogation signal input terminal for receiving an interrogation signal;

a signal transmission unit adapted to be connected to a receiver and converting said fire-determination signal into a multiplex signal for multiplex transmission to said receiver, said signal transmission unit transforming the interrogation signal from said receiver into a suitable format to be processed at said signal processing unit, said signal transmission unit having:

a power input terminal for receiving the operating voltage, an interrogation input terminal for receiving said interrogation signal, a fire-determination input terminal for receiving said fire-determination signal, an interrogation signal output terminal for transmitting said interrogation signal, and an multiplex signal output terminal for transmitting said multiplex signal;

a power unit providing said operating voltage, said power unit including a switch circuit which is adapted to be connected to the receiver for providing a short-circuit signal in accordance with said fire-determination signal, said power unit further including a transfer circuit which transfers said interrogation signal from the receiver to said signal transmission unit as well as said multiplex signal from said signal transmission unit to the receiver, said power unit having:

a power output terminal for providing said operating voltage, a multiplex signal input terminal for receiving said multiples signal, an interrogation output terminal for providing said interrogation signal, a fire-determination input terminal for receiving said fire-presence signal, and a port for connection with the receiver, said method comprising combining at least one of said smoke sensor unit and said thermal sensor unit with said power unit and optionally with at least one of said processing unit and said signal transmission unit.

2. The process as set forth in claim 1, wherein at least one of said smoke sensor unit, said thermal sensor unit, said signal processing unit, said signal transmission unit, and said power unit is realized into an integrated circuit.

3. A fire detector fabricated in accordance with a method of claim 1, wherein said fire detector is equipped with said smoke sensor unit, said thermal sensor unit, said signal processing unit, said signal transmission unit, and said power unit, said smoke sensor unit having said smoke density output terminal connected to said smoke density input terminal of said signal processing unit, said thermal sensor unit having said temperature output terminal connected to said temperature input terminal of said signal processing unit, said signal processing unit having said fire-determination output terminal connected to said fire-determination input terminal of said signal transmission unit, said signal processing unit having said interrogation input terminal connected to said interrogation output terminal of said signal transmission unit, said signal transmission unit having said multiplex signal output terminal connected to said multiplex signal input terminal of said power unit, said signal transmission unit having said interrogation input terminal connected to said interrogation output terminal of said power unit, said power unit having said power output terminal connected to said power input terminals of said smoke sensor unit, said thermal sensor unit, said signal processing unit, and said signal transmission unit.

4. A fire detector fabricated in accordance with a method of claim 1, wherein said fire detector is equipped with said smoke sensor unit, said thermal sensor unit, said signal processing unit, and said power unit, said smoke sensor unit having said smoke density output terminal connected to said smoke density input terminal of said signal processing unit, said thermal sensor unit having said temperature output terminal connected to said temperature input terminal of said signal processing unit, said signal processing unit having said fire-determination output terminal connected to said fire-determination input terminal of said power unit, said power unit having said power output terminal connected to said power input terminals of said smoke sensor unit, said thermal sensor unit, and said signal processing unit.

5. A fire detector fabricated in accordance with a method of claim 1, wherein said fire detector is equipped with said smoke sensor unit, said signal processing unit, said signal transmission unit, and said power unit, said smoke sensor unit having said smoke density output terminal connected to said smoke density input terminal of said signal processing unit, said signal processing unit having said fire-determination output terminal connected to said fire-determination input terminal of said signal transmission unit, said signal processing unit having said interrogation input terminal connected to said interrogation output terminal of said signal transmission unit, said signal transmission unit having said multiplex signal output terminal connected to said multiplex signal input terminal of said power unit, said signal transmission unit having said interrogation input terminal connected to said interrogation output terminal of said power unit, said power unit having said power output terminal connected to said power input terminals of said smoke sensor unit, said signal processing unit, and said signal transmission unit.

6. A fire detector fabricated in accordance with a method of claim 1, wherein said fire detector is equipped with said smoke sensor unit, said signal processing unit, and said power unit, said smoke sensor unit having said smoke density output terminal connected to said smoke density input terminal of said signal processing unit, said signal processing unit having said fire-determination output terminal connected to said fire-determination input terminal of said power unit, said power unit having said power output terminal connected to said power input terminals of said smoke sensor unit and said signal processing unit.

7. A fire detector fabricated in accordance with a method of claim 1, wherein said fire detector is equipped with said smoke sensor unit, said signal transmission unit, and said power unit, said smoke sensor unit having said fire-determination output terminal connected to said fire-determination input terminal of said signal transmission unit, said signal processing unit having said multiplex signal output connected to said multiplex signal input of said power unit, said power unit having said power output terminal connected to said power input terminals of said smoke sensor unit and said signal transmission unit.

8. A fire detector fabricated in accordance with a method of claim 1 wherein said fire detector is equipped with said smoke sensor unit and said power unit, said smoke sensor unit having said fire-determination output terminal connected to said fire-determination input terminal of said power unit, said power unit having said power output terminal connected to said power input terminal of said smoke sensor unit.

9. A fire detector fabricated in accordance with a method of claim 1, wherein said fire detector is equipped with said thermal sensor unit, said signal processing unit, said signal transmission unit, and said power unit, said thermal sensor unit having said temperature output terminal connected to said temperature input terminal of said signal processing unit, said signal processing unit having said fire-determination output terminal connected to said fire-determination input terminal of said signal transmission unit, said signal processing unit having said interrogation input terminal connected to said interrogation output terminal of said signal transmission unit, said signal transmission unit having said multiplex signal output terminal connected to said multiplex signal input of said power unit, said signal transmission unit having said interrogation input terminal connected to said interrogation output terminal of said power unit, said power unit having said power output terminal connected to said power input terminals of said thermal sensor unit, said signal processing unit, and said signal transmission unit.

10. A fire detector fabricated in accordance with a method of claim 1, wherein said fire detector is equipped with said thermal sensor unit, said signal processing unit, and said power unit, said thermal sensor unit having said temperature output terminal connected to said temperature input terminal of said signal processing unit, said signal processing unit having said fire-determination output terminal connected to said fire-determination input terminal of said power unit, said power unit having said power output terminal connected to said power input terminals of said thermal sensor unit and said signal processing unit.

* * * * *